US010350914B2

(12) United States Patent
Kanazawa et al.

(10) Patent No.: US 10,350,914 B2
(45) Date of Patent: Jul. 16, 2019

(54) INK-JET RECORDING APPARATUS

(71) Applicant: BROTHER KOGYO KABUSHIKI KAISHA, Nagoya-shi, Aichi-ken (JP)

(72) Inventors: Gakuro Kanazawa, Toyokawa (JP); Iwane Sano, Obu (JP); Tsuyoshi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/793,021

(22) Filed: Oct. 25, 2017

(65) Prior Publication Data

US 2018/0118494 A1 May 3, 2018

(30) Foreign Application Priority Data

Oct. 31, 2016 (JP) ..... 2016-212610

(51) Int. Cl.
*B65H 29/12* (2006.01)
*B65H 29/52* (2006.01)
(Continued)

(52) U.S. Cl.
CPC ..... *B41J 11/0065* (2013.01); *B41J 2/15* (2013.01); *B41J 11/0005* (2013.01); *B41J 11/0025* (2013.01); *B41J 11/0045* (2013.01); *B41J 11/06* (2013.01); *B41J 11/08* (2013.01); *B41J 13/0054* (2013.01); *B65H 5/062* (2013.01);
(Continued)

(58) Field of Classification Search
CPC ..... B65H 29/125; B65H 5/062; B65H 5/068; B41J 11/0005; B41J 11/0025; B41J 11/0045; B41J 11/0065; B41J 13/0054; B41J 2/15; B41J 11/08
See application file for complete search history.

(56) References Cited

U.S. PATENT DOCUMENTS

2003/0035039 A1* 2/2003 Kanome ..... B41J 11/0015 347/104
2012/0218361 A1* 8/2012 Okuno ..... B41J 11/0065 347/104
(Continued)

FOREIGN PATENT DOCUMENTS

JP 2013-230620 A 11/2013
JP 2014-156072 A 8/2014

*Primary Examiner* — Kristal Feggins
*Assistant Examiner* — Kendrick X Liu
(74) *Attorney, Agent, or Firm* — Merchant & Gould P.C.

(57) ABSTRACT

An ink-jet recording apparatus includes: an image recorder; a first supporter including support ribs extending to positions under the image recorder; an ink receiver disposed downstream of the support ribs; first and second roller pairs disposed downstream of the first supporter; a guide; and a protrusion disposed between the ink receiver and the first roller pair and having an upper end located below upper ends of the support ribs and above a first imaginary line connecting between a nip position of the first roller pair and a downstream end of the ink receiver. A distance between an upstream end of the ink receiver and a nip position of the second roller pair is less than a length of a first-size sheet and greater than a length of a second-size sheet. The protrusion is disposed, in a widthwise direction, in a region through which the second-size sheet is conveyed.

10 Claims, 12 Drawing Sheets

(51) Int. Cl.

| | |
|---|---|
| ***B41J 11/00*** | (2006.01) |
| ***B41J 11/08*** | (2006.01) |
| ***B41J 2/15*** | (2006.01) |
| ***B41J 13/00*** | (2006.01) |
| ***B65H 5/06*** | (2006.01) |
| ***B65H 5/38*** | (2006.01) |
| ***B41J 11/06*** | (2006.01) |
| ***B65H 29/70*** | (2006.01) |
| ***B65H 5/36*** | (2006.01) |
| *B41J 2/135* | (2006.01) |
| *B65H 7/02* | (2006.01) |

(52) U.S. Cl.

CPC ..... *B65H 5/36* (2013.01); *B65H 5/38* (2013.01); *B65H 29/12* (2013.01); *B65H 29/125* (2013.01); *B65H 29/52* (2013.01); *B65H 29/70* (2013.01); *B41J 2/135* (2013.01); *B65H 7/02* (2013.01); *B65H 2301/5122* (2013.01); *B65H 2301/51214* (2013.01); *B65H 2402/5441* (2013.01); *B65H 2404/1115* (2013.01); *B65H 2404/513* (2013.01); *B65H 2404/5214* (2013.01); *B65H 2801/12* (2013.01)

(56) References Cited

U.S. PATENT DOCUMENTS

| | | | | |
|---|---|---|---|---|
| 2013/0135409 | A1* | 5/2013 | Ito ..... | B41J 11/006 347/104 |
| 2013/0286127 | A1 | 10/2013 | Samoto et al. | |
| 2014/0232789 | A1 | 8/2014 | Mimoto et al. | |

* cited by examiner

INK-JET RECORDING APPARATUS

CROSS REFERENCE TO RELATED APPLICATION

The present application claims priority from Japanese Patent Application No. 2016-212610, which was filed on Oct. 31, 2016, the disclosure of which is herein incorporated by reference in its entirety.

BACKGROUND

The following disclosure relates to an ink-jet recording apparatus configured to eject ink droplets from nozzles to perform image recording on a sheet.

There is known an ink-jet recording apparatus configured to eject ink droplets to record an image on a sheet. This image recording is performed by ejecting the ink droplets onto the sheet from nozzles formed in a nozzle surface of a recording head.

In this ink-jet recording apparatus, when the ink droplets are ejected on the sheet from the nozzles, the ink is absorbed in the sheet, so that the sheet may be deformed by water of the ink such that a recording surface of the sheet swells upward. In case where the sheet is deformed in this manner, the recording surface of the sheet may be soiled by contacting the nozzle surface.

In order to solve the problem in which a leading edge portion of the swollen sheet is soiled by contacting the nozzle surface, for example, the ink-jet recording apparatus includes a guide member disposed downstream, in a sheet conveying direction, of a support member opposed to the recording head to support the sheet. The guide member is inclined from a position below the support member so as to be higher at a downstream portion of the guide member in the sheet conveying direction than at an upstream portion of the guide member in the sheet conveying direction. The guide member guides the sheet to a sheet-output roller pair after image recording on the recording surface of the sheet. With this construction, the leading edge portion of the sheet swollen upward by the absorbed ink is hung down by its own weight toward a guide surface of the guide member, thereby preventing the sheet swollen upward from contacting the nozzle surface of the recording head.

Also, there is known another ink-jet recording apparatus including: a first sheet-output roller pair disposed, in the conveying direction, downstream of a support member for supporting a sheet; and a second sheet-output roller pair disposed downstream of the first sheet-output roller pair in the conveying direction. These two sheet-output roller pairs discharge the sheet.

SUMMARY

When the sheet is conveyed by being nipped by the sheet-output roller pair or pairs after the image recording, a trailing edge of the sheet is hung down by the weight of the sheet. The support member opposed to the recording head to support the sheet has a non-recorded-ink receiving region on which the ink droplets ejected toward the outside of the sheet are to be landed in borderless printing for recording an image on the sheet without any margin. When the trailing edge of the sheet hangs down, as described above, the trailing edge may be brought into contact and soiled with the ink accumulated in the non-recorded-ink receiving region.

In the construction in which the two sheet-output roller pairs are provided, in particular, when compared with the case where image recording is performed on a sheet whose trailing edge reaches the non-recorded-ink receiving region in a state in which the sheet is nipped by the two sheet-output roller pairs, in the case where image recording is performed on a small-size sheet, such as a postcard, whose trailing edge reaches the non-recorded-ink receiving region in a state in which the sheet is nipped only by the first sheet-output roller pair, a posture of a leading edge portion of the sheet is not stable, leading to easy change of a posture of the entire sheet. Thus, the trailing edge of the small-size sheet is easily hung down and soiled with the ink by contacting.

To reduce the hanging-down of the trailing edge of the sheet, it is possible to consider that protrusions, such as ribs, for supporting a lower surface of the sheet are arranged in a widthwise direction between the support member and the sheet-output roller pair to support a trailing edge portion of the sheet. However, if the protrusions are provided for the above-described recording apparatus including the guide member inclined such that the leading edge portion of the swollen sheet hangs down, the protrusions unfortunately support the leading edge portion of the sheet. Thus, there is a possibility that the leading edge portion of the sheet cannot sufficiently hang down toward the guide member, and it is not possible to prevent the swollen sheet from contacting the nozzle surface of the recording head.

Accordingly, an aspect of the disclosure relates to an ink-jet recording apparatus that has a space which is located downstream of a support member in a conveying direction and in which a leading edge portion of a sheet swollen by the ink absorbed therein hangs down, and that is configured to prevent a trailing edge portion of a small-size sheet from being soiled by contacting the ink receiver of the support member.

In one aspect of the disclosure, an ink-jet recording apparatus includes: an image recorder defining therein a plurality of nozzles and configured to eject ink from the plurality of nozzles onto a sheet to perform image recording, the image recorder being capable of performing the image recording on any of a first-size sheet and a second-size sheet, the first-size sheet having a first size, the second-size sheet having a second size different from the first size, wherein a length of the second-size sheet in a conveying direction in which the sheet is conveyed is less than a length of the first-size sheet in the conveying direction, and a length of the second-size sheet in a widthwise direction orthogonal to the conveying direction is less than a length of the first-size sheet in the widthwise direction; a first supporter having a plurality of support ribs spaced apart from each other in the widthwise direction, the plurality of support ribs each extending from a position located upstream of the image recorder in the conveying direction toward a position located downstream of the image recorder in the conveying direction to a position under the image recorder to support the sheet; an ink receiver disposed downstream of the plurality of support ribs in the conveying direction and below the plurality of support ribs, the ink receiver being configured to receive the ink ejected from the plurality of nozzles of the image recorder when borderless printing is performed on one of a downstream edge and an upstream edge of the sheet in the conveying direction; a first roller pair disposed downstream of the first supporter in the conveying direction and configured to convey the sheet in the conveying direction; a second roller pair disposed downstream of the first roller pair in the conveying direction; a guide having a guide surface extending from a position located downstream of the ink receiver in the conveying direction and below the ink receiver, toward a downstream side in the conveying direction and toward a nip position of the first roller pair at which the sheet is nipped by the first roller pair, the guide surface being configured to guide the sheet toward the nip position of the first roller pair; and a protrusion disposed between the ink receiver and the first roller pair, an upper end of the protrusion being located below upper ends of the plurality of support ribs and above a first imaginary line connecting between the nip position of the first roller pair and a downstream end of the ink receiver in the conveying direction. A distance between an upstream end of the ink receiver in the conveying direction and a nip position of the second roller pair at which the sheet is nipped by the second roller pair is less than the length of the first-size sheet in the conveying direction and greater than the length of the second-size sheet in the conveying direction. The protrusion is disposed, in the widthwise direction, in a region through which the second-size sheet is conveyed.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 (as one example of an ink-jet recording apparatus) is normally used in a state illustrated in FIG. 1. In the following description, the up and down direction 7 is defined in this state. The front and rear direction 8 is defined by regarding a side of the MFP 10 on which an opening is formed as a front side, and the right and left direction 9 is defined in a state in which the MFP 10 is seen from a front side thereof.

MFP 10

Figure 1:
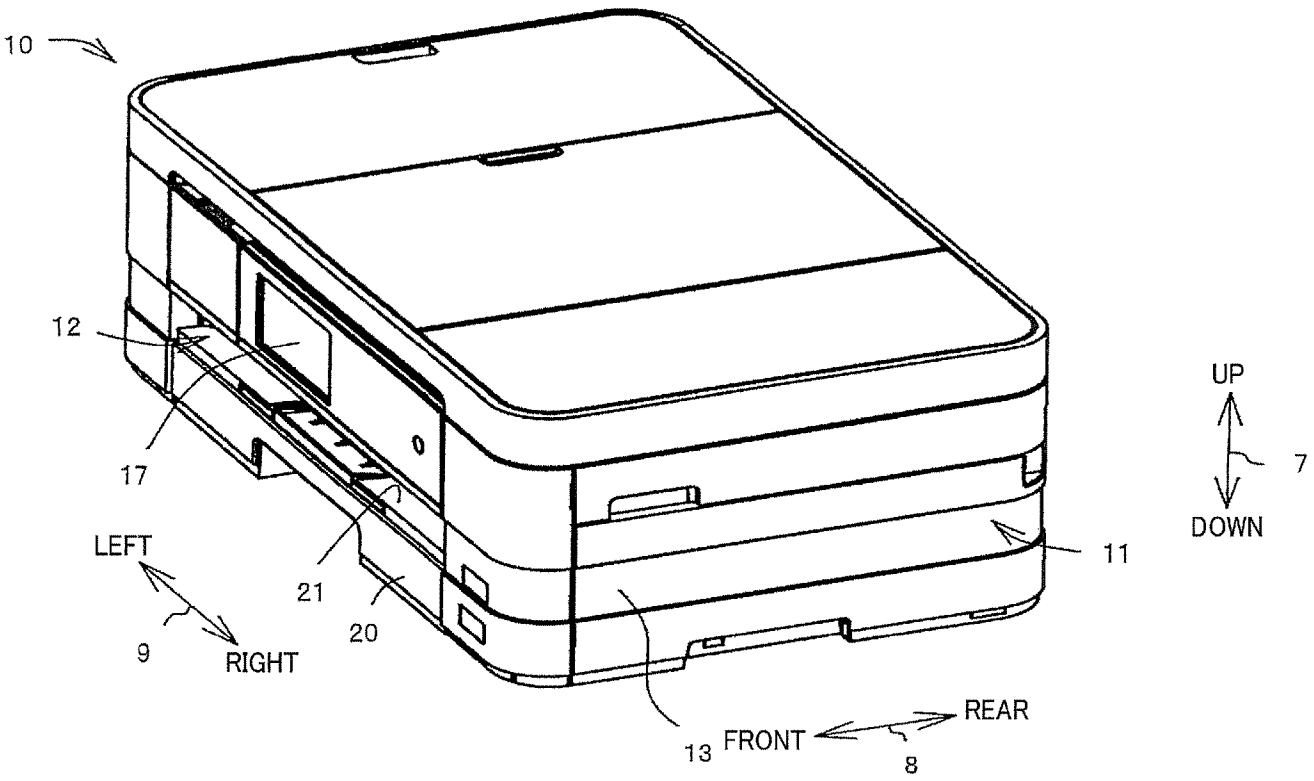
FIG. 1 is a perspective view of a multi-function peripheral (MFP)

As illustrated in FIG. 1, the MFP 10 has a generally thin rectangular parallelepiped shape. A printer 11 is provided in a lower portion of the MFP 10. The MFP 10 has various functions including a printing function, a facsimile function, and a reading function achieved by scanning. As the printing function, the MFP 10 has a function of ink-jet recording of an image on one side (surface) of a sheet P (see FIG. 2). It is noted that the MFP 10 may be configured to record images on both sides of the sheet P.

The MFP 10 is capable of performing image recording on the sheets P of various sizes according to Japanese Industrial Standards (JIS). Among the plurality of sizes, a small size in the present embodiment refers to the smallest one of the sizes of the sheets P set to be printable in the MFP 10. Here, one example of the sheet P of the small size is a postcard which may be hereinafter referred to as "small-size sheet P1". An ordinary size in the present embodiment refers to a size larger than the small size. Here, one example of the sheet P of the ordinary size is a sheet of the A4 size which may be hereinafter referred to as "ordinary-size sheet P2". It is noted that when the sizes of the sheets need not be distinguished from each other, the sheets of all sizes will be collectively referred to as "sheet P". In this MFP 10, the ordinary-size sheet P2 is conveyed such that one of its long sides serves as a leading edge in a conveying direction 15 which will be described below. The small-size sheet P1 is conveyed such that one of its short sides serves as a leading edge in the conveying direction 15. Since a grain (textile) of the ordinary-size sheet P2 (i.e., the sheets of the A4 size) extends along a long side of the sheet P2, the sheet P2 is conveyed by what is called short-grain conveyance.

Figure 2:
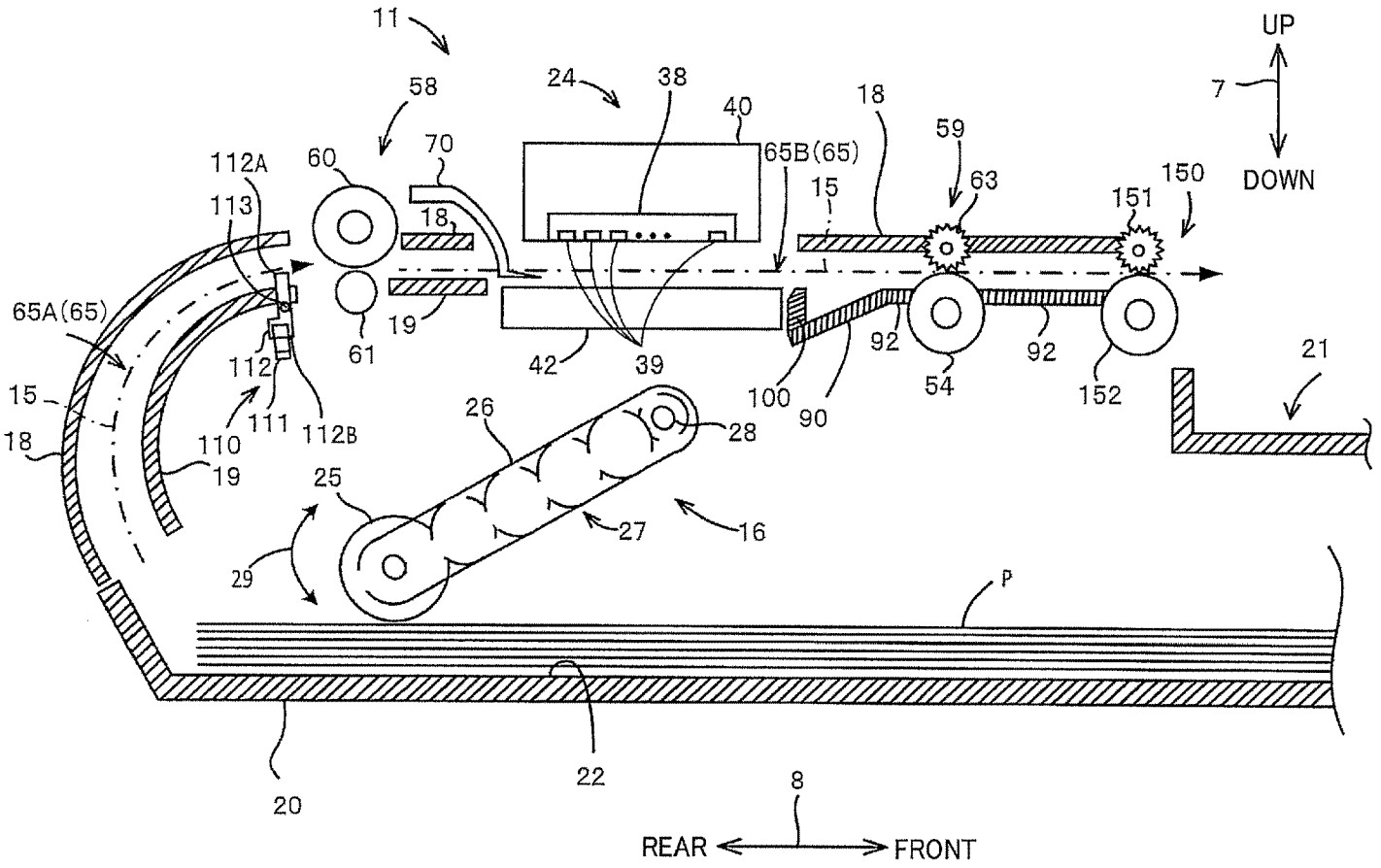
FIG. 2 is an elevational view schematically illustrating an internal structure of a printer.

As illustrated in FIG. 2, the printer 11 includes: a sheet supplier 16 configured to supply the sheet P to a conveyance path 65; a conveying roller pair 58 configured to convey the sheet P supplied to the conveyance path 65; a first output roller pair 59 (as one example of a first roller pair) and a second output roller pair 150 (as one example of a second roller pair) for discharging the sheet P; a platen 42 (as one example of a support member) that supports the sheet P conveyed on the conveyance path 65; and an image recorder 24 configured to record an image on the sheet P supported on the platen 42. The sheet supplier 16 (driven by a sheet-supply motor which will be described below), the conveying roller pair 58, the first output roller pair 59, and the second output roller pair 150 (driven by a conveying motor which will be described below), and the image recorder 24 (specifically, a recording head 38 and a carriage driving motor which will be described below) are controlled by a controller 140.

Sheet-Supply Tray 20

As illustrated in FIG. 1, the printer 11 includes a housing 13 having an opening 12 in its front surface. A sheet-supply tray 20 is movable in the front and rear direction 8 and thereby insertable into and removable from the printer 11 through the opening 12. The sheet-supply tray 20 is shaped like a box opening upward. As illustrated in FIG. 2, the sheets P are stacked on each other on a bottom plate 22 of the sheet-supply tray 20. The sheet-supply tray 20 is capable of selectively holding one of the sizes of the sheets P including the ordinary-size sheets P2 and the small-size sheets P1. The sheet-supply tray 20 accommodates the ordinary-size sheets P2, with their long sides extending parallel with the right and left direction 9. The sheet-supply tray 20 accommodates the small-size sheets P1, with their short sides extending parallel with the right and left direction 9. That is, the ordinary-size sheets P2 are supported on the bottom plate 22 in what is called lateral placement in which the short sides of the sheets P2 extend along the conveying direction 15. The ordinary-size sheets P2 are disposed on the sheet-supply tray 20 such that central portions of the ordinary-size sheets P2 in the right and left direction 9 are aligned with a central portion of the sheet-supply tray 20 in the right and left direction 9. Likewise, the small-size sheets P1 are disposed on the sheet-supply tray 20 such that central portions of the small-size sheet P1 in the right and left direction 9 are aligned with the central portion of the sheet-supply tray 20 in the right and left direction 9. That is, the sheets P are placed on the sheet-supply tray 20 such that the central portions of the sheets are aligned with the central portion of the sheet-supply tray 20. A sheet-output tray 21 is supported over a front portion of the sheet-supply tray 20. The sheet-output tray 21 and the sheet-supply tray 20 are moved in the front and rear direction 8 in a unit. The sheet P on which an image has been recorded by the image recorder 24 which will be described below is discharged onto an upper surface of the sheet-output tray 21. It is noted that the sheet-output tray 21 may be supported by the printer 11.

Operation Device 17

As illustrated in FIG. 1, an operation device 17 such as a touch screen is provided on an upper portion of a front portion of the MFP 10. When information required for printing is input to the operation device 17 by a user, the controller 140 executes a processing for image recording based on the input information. It is noted that the MFP 10 may perform image recording based on information input from an external device connected to the MFP 10 over a wired or wireless communication network.

Sheet Supplier 16

As illustrated in FIG. 2, the sheet supplier 16 is provided over the sheet-supply tray 20. The sheet supplier 16 includes a sheet-supply roller 25, a sheet-supply arm 26, a drive-power transmitting mechanism 27, and a shaft 28. The sheet-supply roller 25 is rotatably supported by a distal end portion of the sheet-supply arm 26. The sheet-supply arm 26 pivots about the shaft 28 in directions indicated by arrows 29. The shaft 28 is provided on a basal end portion of the sheet-supply arm 26. The pivotal movement of the sheet-supply arm 26 moves the sheet-supply roller 25 toward and away from the sheet-supply tray 20 or the sheets P supported on the sheet-supply tray 20. The sheet-supply roller 25 is rotated by a driving force produced by the sheet-supply motor, not illustrated, and transmitted by the drive-power transmitting mechanism 27 including a plurality of gears meshed with each other. This rotation of the sheet-supply roller 25 supplies, to the conveyance path 65, the uppermost one of the sheets P supported on the bottom plate 22 of the sheet-supply tray 20.

Conveyance Path 65

As illustrated in FIG. 2, the conveyance path 65 extends from a rear end portion of the sheet-supply tray 20. The conveyance path 65 includes a curved portion 65A and a straight portion 65B. The curved portion 65A is curved in a state in which its rear portion serves as an outer portion of the curve, and its front portion serves as an inner portion of the curve. The straight portion 65B extends along the front and rear direction 8. The conveyance path 65 is defined by an outer guide member 18 and an inner guide member 19 opposed to each other at a predetermined distance therebetween. The sheet P supplied from the sheet-supply tray 20 to the conveyance path 65 by the sheet supplier 16 is conveyed through the curved portion 65A so as to make an upward U-turn and then conveyed along the straight portion 65B to the image recorder 24. After image recording by the image recorder 24, the sheet P is conveyed along the straight portion 65B and discharged onto the sheet-output tray 21. That is, the sheet P is conveyed in the conveying direction 15 indicated by the one-dot-chain-line arrows in FIG. 2.

Image Recorder 24

As illustrated in FIG. 2, the image recorder 24 is provided over the straight portion 65B of the conveyance path 65. The image recorder 24 includes a carriage 40 and the recording head 38. The carriage 40 is supported in the printer 11 by a pair of guide rails, not illustrated, spaced apart from each other at a predetermined distance in the front and rear direction 8. Each of the guide rails extends in the right and left direction 9. The carriage 40 is movable in the right and left direction 9 (as one example of a widthwise direction) on the two guide rails. The carriage 40 is moved by a driving force received from the carriage driving motor, not illustrated.

The recording head 38 is mounted on the carriage 40. Ink is supplied to the recording head 38 from an ink cartridge, not illustrated, for storing the ink. A multiplicity of nozzles 39 are formed in a lower surface of the recording head 38. In image recording, the recording head 38 ejects ink droplets from the nozzles 39 toward the platen 42, which will be described below, during reciprocation of the carriage 40 in the right and left direction 9. The sheet P conveyed in the conveying direction 15 is supported on the platen 42.

That is, the ink droplets are ejected from the nozzles 39 of the recording head 38 onto the sheet P conveyed on the platen 42 along the straight portion 65B, with reciprocation of the carriage 40 in the right and left direction 9. As a result, an image is recorded on the sheet P.

Conveying Roller Pair 58, First Output Roller Pair 59, and Second Output Roller Pair 150

As illustrated in FIG. 2, the conveying roller pair 58 is provided on the conveyance path 65 at a position located upstream of the platen 42 in the conveying direction 15. The conveying roller pair 58 includes: a conveying roller 60 disposed in an upper portion of the conveyance path 65; and a pinch roller 61 disposed in a lower portion of the conveyance path 65 so as to be opposed to the conveying roller 60.

The pinch roller 61 is held in contact with a roller surface of the conveying roller 60 by a resilient member, not illustrated, such as a spring.

As illustrated in FIG. 2, the first output roller pair 59 is provided on the conveyance path 65 at a position located downstream of the platen 42 in the conveying direction 15. The first output roller pair 59 includes: a first output roller 62 disposed in a lower portion of the conveyance path 65; and a first spur 63 disposed in an upper portion of the conveyance path 65 so as to be opposed to the first output roller 62. The first spur 63 is held in contact with a roller surface of the first output roller 62 by a resilient member, not illustrated, such as a spring.

As illustrated in FIG. 2, the second output roller pair 150 is provided in the conveyance path 65 at a position located downstream of the first output roller pair 59 in the conveying direction 15. The second output roller pair 150 includes a second output roller 152 disposed in a lower portion of the conveyance path 65; and a third spur 151 disposed in an upper portion of the conveyance path 65 so as to be opposed to the second output roller 152. The third spur 151 is held in contact with a roller surface of the second output roller 152 by a resilient member, not illustrated, such as a spring.

The conveying roller 60, the first output roller 62, and the second output roller 152 are rotated by a driving force received from the conveying motor, not illustrated, via the drive-power transmitting mechanism, not illustrated. When the conveying roller 60 is rotated in a state in which the sheet P is nipped by the conveying roller pair 58, the sheet P is conveyed by the conveying roller pair 58 onto the platen 42 in the conveying direction 15. When the first output roller 62 is rotated in a state in which the sheet P is nipped by the first output roller pair 59, the sheet P is conveyed by the first output roller pair 59 in the conveying direction 15. When the second output roller 152 is rotated in a state in which the sheet P is nipped by the second output roller pair 150, the sheet P is conveyed by the second output roller pair 150 in the conveying direction 15. As illustrated in FIG. 2, a nipping position of the sheet P by the conveying roller pair 58, a nipping position of the sheet P by the first output roller pair 59, and a nipping position of the sheet P by the second output roller pair 150 are located at a height level that is higher than that of the platen 42. The conveying roller pair 58, the first output roller pair 59, and the second output roller pair 150 as described above convey the sheet P in the conveying direction 15 by nipping the sheet P.

Registering Sensor 110

As illustrated in FIG. 2, the printer 11 includes a registering sensor 110 in the curved portion 65A at a particular position located between the sheet-supply roller 25 and the conveying roller pair 58. The registering sensor 110 detects the presence or absence of the sheet P at the particular position and outputs a signal (a detection signal) based on a result of the detection. For example, the registering sensor 110 outputs a high-level signal when a portion of the sheet P is being conveyed at the registering sensor 110, and outputs a low-level signal when the sheet P is not being conveyed at the registering sensor 110.

The registering sensor 110 includes: a rotational member 112 including detectors 112A, 112B; and an optical sensor 111, such as a photo interrupter, including a light emitting element (e.g., a light-emitting diode), and a light receiving element (e.g., a phototransistor) configured to receive light emitted from the light emitting element. The rotational member 112 is provided so as to be rotatable about a shaft 113. The detector 112A protrudes from the shaft 113 to the conveyance path 65.

When a leading edge of the sheet P conveyed along the conveyance path 65 (a downstream edge of the sheet P in the conveying direction 15) is brought into contact with the detector 112A of the rotational member 112 so as to push the detector 112A, the detector 112B of the rotational member 112 is moved off a light path extending between the light emitting element and the light receiving element. As a result, the light emitted from the light emitting element is received by the light receiving element. In this case, the light receiving element outputs the high-level signal. When a trailing edge of the sheet P conveyed along the conveyance path 65 (an upstream edge of the sheet P in the conveying direction 15) passes through the detector 112A of the rotational member 112, the rotational member 112 returns to its state illustrated in FIG. 2. In this state, the detector 112B of the rotational member 112 enters the light path between the light emitting element and the light receiving element to intercept the light passing through the light path. In this case, the light receiving element outputs the low-level signal. The optical sensor 111 outputs an analog electric signal, as a detection signal, based on the strength of the light received by the light receiving element. The controller 140 configured to control overall operations of the MFP 10 detects the presence or absence of the sheet P at the particular position based on the electric signal output from the optical sensor 111.

In the present embodiment, the contact-type registering sensor configured to detect the presence or absence of the sheet P by contact of the sheet P with the rotational member 112 is employed as one example of the registering sensor 110. However, the type of the registering sensor 110 is not limited to the contact type. For example, the registering sensor 110 may be an optical registering sensor configured to emit light toward the conveyance path 65 and detect the presence or absence of the sheet P based on a change of the strength of light reflected from a surface of the sheet P.

Platen 42

Figure 3:
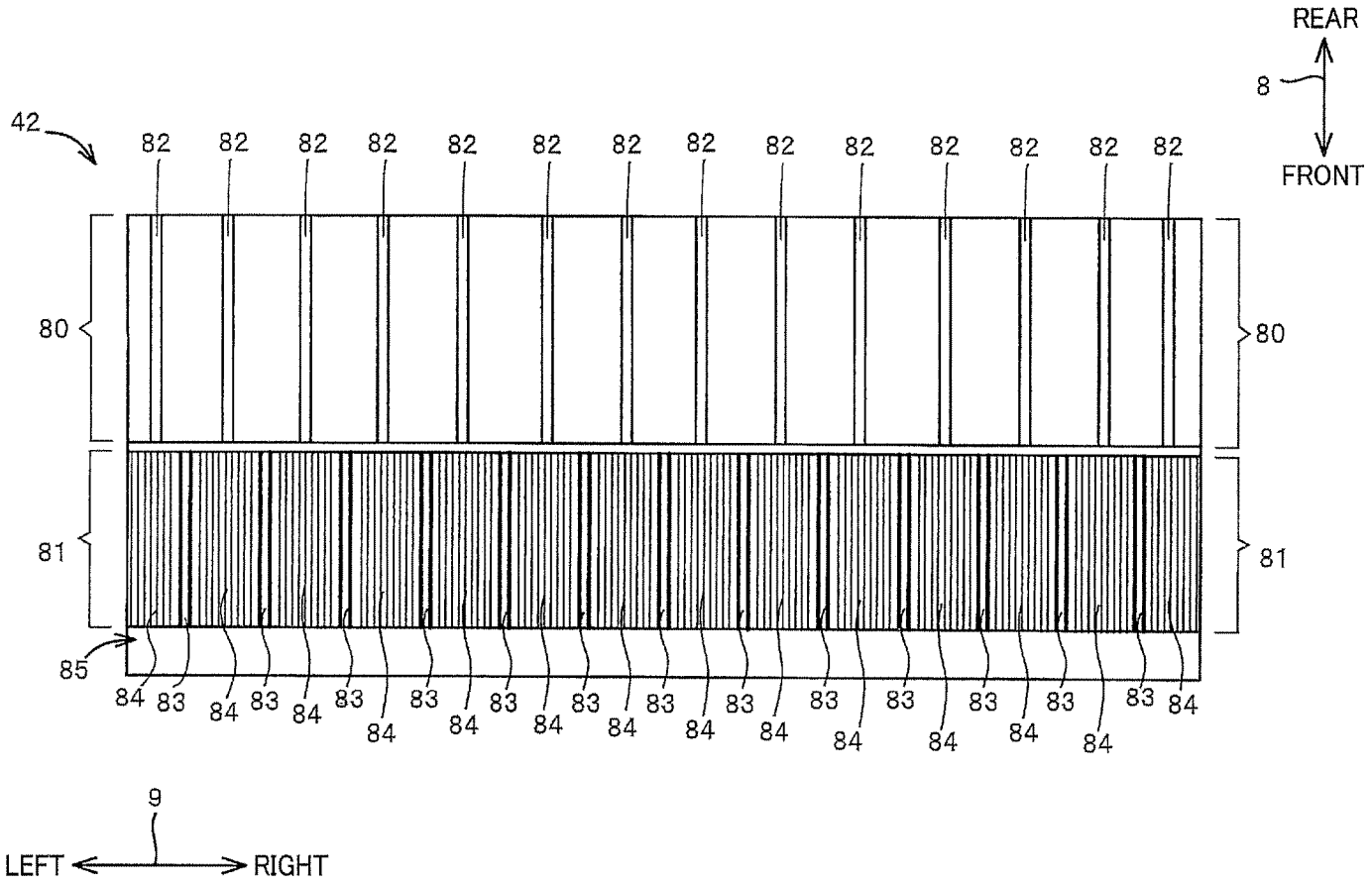
FIG. 3 is a plan view illustrating a planar structure of a platen disposed in the printer.

As illustrated in FIG. 2, the platen 42 is disposed below the straight portion 65B of the conveyance path 65 so as to be opposed to the image recorder 24 at a predetermined distance between the platen 42 and the image recorder 24. As illustrated in FIG. 3, the platen 42 includes: a first supporter 80; a second supporter 81 located in front of the first supporter 80; and an accommodating portion 85 located in front of the second supporter 81.

As illustrated in FIG. 3, the first supporter 80 is formed with a plurality of upstream ribs 82 (each as one example of a support rib) spaced apart from each other in the right and left direction 9. The upstream ribs 82 are provided upright from an upper surface of a base plate portion of the first supporter 80. Each of the upstream ribs 82 extends in the front and rear direction 8, and its upper end supports the sheet P conveyed along the conveyance path 65.

Figure 4:
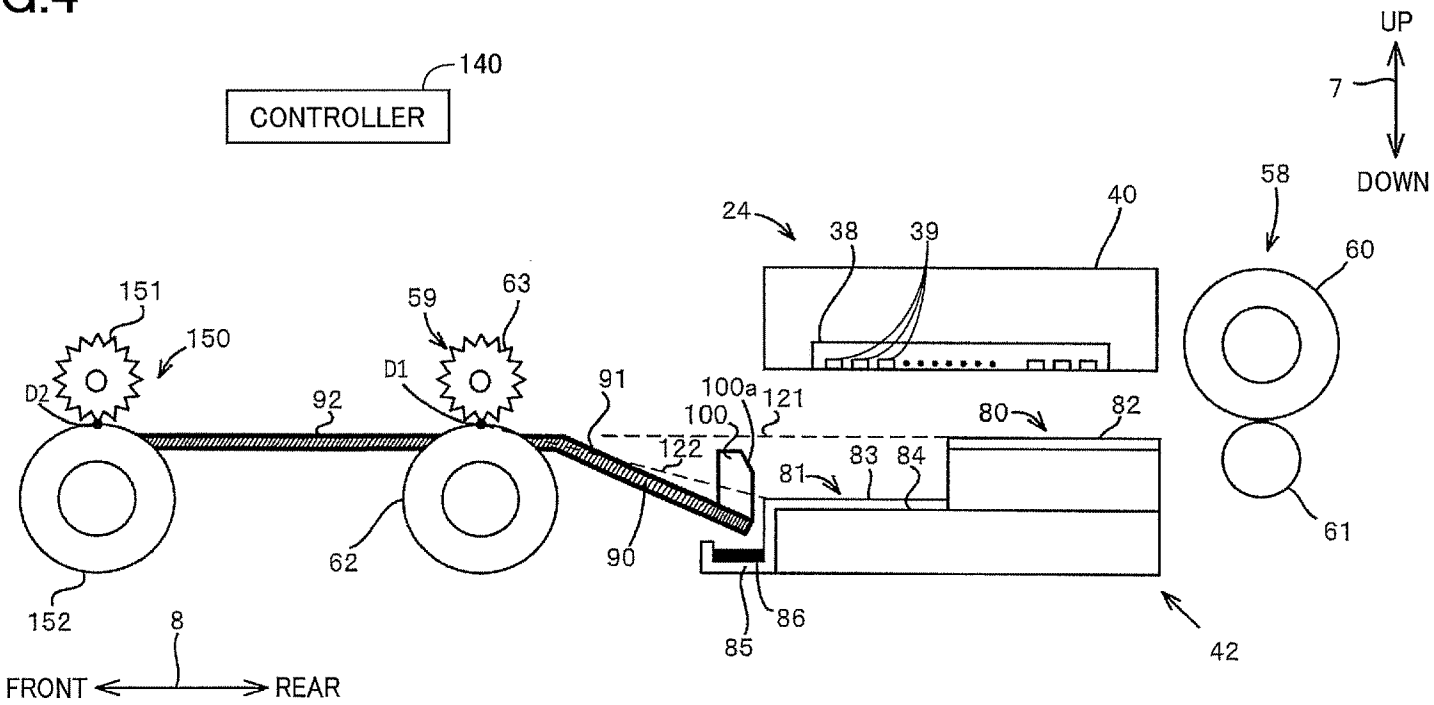
FIG. 4 is a side view schematically illustrating a structure of protrusions and components provided near the protrusions.

The second supporter 81 includes ink landing portions 84 (each as one example of an ink receiver) and downstream ribs 83. The ink landing portions 84 are spaced apart from each other in the right and left direction 9. As illustrated in FIG. 4, when the recording head 39 are reciprocated over the platen 42, upper surfaces of the respective ink landing portions 84 are opposed to downstream ones of the nozzles 39 formed in the recording head 38 in the conveying direction 15. When borderless printing is performed in which the image recorder 24 ejects the ink droplets onto the entire sheet P without any margin, the ink landing portions 84 are located just under areas near a leading edge, a trailing edge, a right edge, and a left edge of the sheet P in the conveying direction 15. The recording head 38 performs the borderless printing on the leading edge, the trailing edge, the right edge, and the left edge of the sheet P in the conveying direction 15 by using ones of the nozzles 39 which are opposed to the ink landing portions 84. As will be described later, each of the ink landing portions 84 extends in the front and rear direction 8, and a portion of the ink landing portion 84 onto which the ink droplet is ejected in the borderless printing actually functions as the ink receiver. It is noted that the ink landing portions 84 need not be formed integrally with the platen 42 and may be independent from the platen 42. For example, the MFP 10 may be configured such that a sponge member formed of a porous material such as foamed polyurethane is provided separately from the platen 42 as the ink landing portions 84 to absorb the ink ejected from the nozzles 39 in the borderless printing.

As illustrated in FIG. 3, each of the ink landing portions 84 has a plurality of grooves each extending in the front and rear direction 8. In the case where the image recorder 24 performs the borderless printing on the sheet P, the ink droplets ejected from the nozzles 39 toward an outside of the edges of the sheet P land on the ink landing portions 84. The ink ejected on the ink landing portions 84 flows frontward along the grooves so as to be absorbed into an ink absorber 86 accommodated in the accommodating portion 85.

The downstream ribs 83 are provided on the second supporter 81 so as to be spaced apart from each other in the right and left direction 9. The downstream ribs 83 are provided upright from an upper surface of a base plate portion of the second supporter 81. Each of the downstream ribs 83 extends from a rear end portion of the second supporter 81 to a front end portion of the second supporter 81. As illustrated in FIG. 4, upper ends of the respective downstream ribs 83 are located below upper ends of the respective upstream ribs 82 and above the upper surfaces of the respective ink landing portions 84. With this construction, the upper ends of the respective downstream ribs 83 support the sheet P to prevent the sheet P being conveyed along the conveyance path 65 from being soiled with the ink ejected on the ink landing portions 84 in the borderless printing and remaining thereon.

As illustrated in FIGS. 3 and 4, the accommodating portion 85 extends in front of the second supporter 81. The accommodating portion 85 is disposed below the upper surfaces of the respective ink landing portions 84 of the second supporter 81. As illustrated in FIG. 4, the accommodating portion 85 accommodates the ink absorber 86. The ink absorber 86 is formed of a porous material such as foamed polyurethane. As described above, the ink ejected on the ink landing portions 84 flows to the accommodating portion 85 along the grooves formed in the ink landing portions 84, and is absorbed into the ink absorber 86.

First Guide Member 90 and Second Guide Member 92

As illustrated in FIG. 4, a first guide member 90 (as one example of a guide member) is provided in front of the platen 42. An upper surface of the first guide member 90 is an inclined surface 91 (as one example of a guide surface). That is, the first guide member 90 has the inclined surface 91. A rear end portion of the inclined surface 91 is located below a front end portion thereof. The rear end portion of the inclined surface 91 is located below the upper surfaces of the respective ink landing portions 84 of the second supporter 81 and above the ink absorber 86. The inclined surface 91 is inclined so as to be higher at its front end portion than at its rear end portion and so as to be nearer to the nipping position of the sheet P by the first output roller pair 59 at the front end portion than at the rear end portion.

As illustrated in FIG. 4, a second guide member 92 extends from a front end portion of the first guide member 90. The second guide member 92 extends in a straight line horizontally frontward from the front end portion of the inclined surface 91. The length of each of the first guide member 90 and the second guide member 92 in the right and left direction 9 is greater than that of the sheet P in the right and left direction 9. The height level of an upper surface of the second guide member 92 is equal in the up and down direction 7 to that of an upper end of the first supporter 80 of the platen 42, i.e., the upper ends of the respective upstream ribs 82. The leading edge of the sheet P conveyed through the platen 42 is guided by the first guide member 90 and the second guide member 92 to the nipping position D1 of the sheet P by the first output roller pair 59. Thereafter, the sheet P conveyed by the first output roller pair 59 toward the second output roller pair 150 is guided along the second guide member 92 to the nipping position D2 of the sheet P by the second output roller pair 150 and discharged onto the sheet-output tray 21 (see FIG. 2) by the second output roller pair 150.

Protrusions 100

As illustrated in FIGS. 2 and 4, protrusions 100 are disposed between the second supporter 81 of the platen 42 and the second guide member 92 in the front and rear direction 8. The protrusions 100 support a lower surface of the sheet P conveyed after image recording thereof by the image recorder 24. The protrusions 100 are provided upright from a rear end portion of the first guide member 90. As illustrated in FIG. 4, the height level of upper ends of the respective protrusions 100 in the up and down direction 7 is higher than an imaginary line 122 (as one example of a first imaginary line) connecting between the nipping position D1 and front end portions of the upper ends of the respective downstream ribs 83 of the second supporter 81 and is lower than an imaginary line 121 horizontally extending in the front and rear direction 8 from the upper ends of the respective upstream ribs 82 of the first supporter 80. A rear surface of each of the protrusions 100 in the front and rear direction 8 has an inclined surface 100*a* inclined such that its upper portion is located in front of its lower portion in the front and rear direction 8. The inclined surface 100 extends to the upper end of a corresponding one of the protrusions 100.

Figure 5:
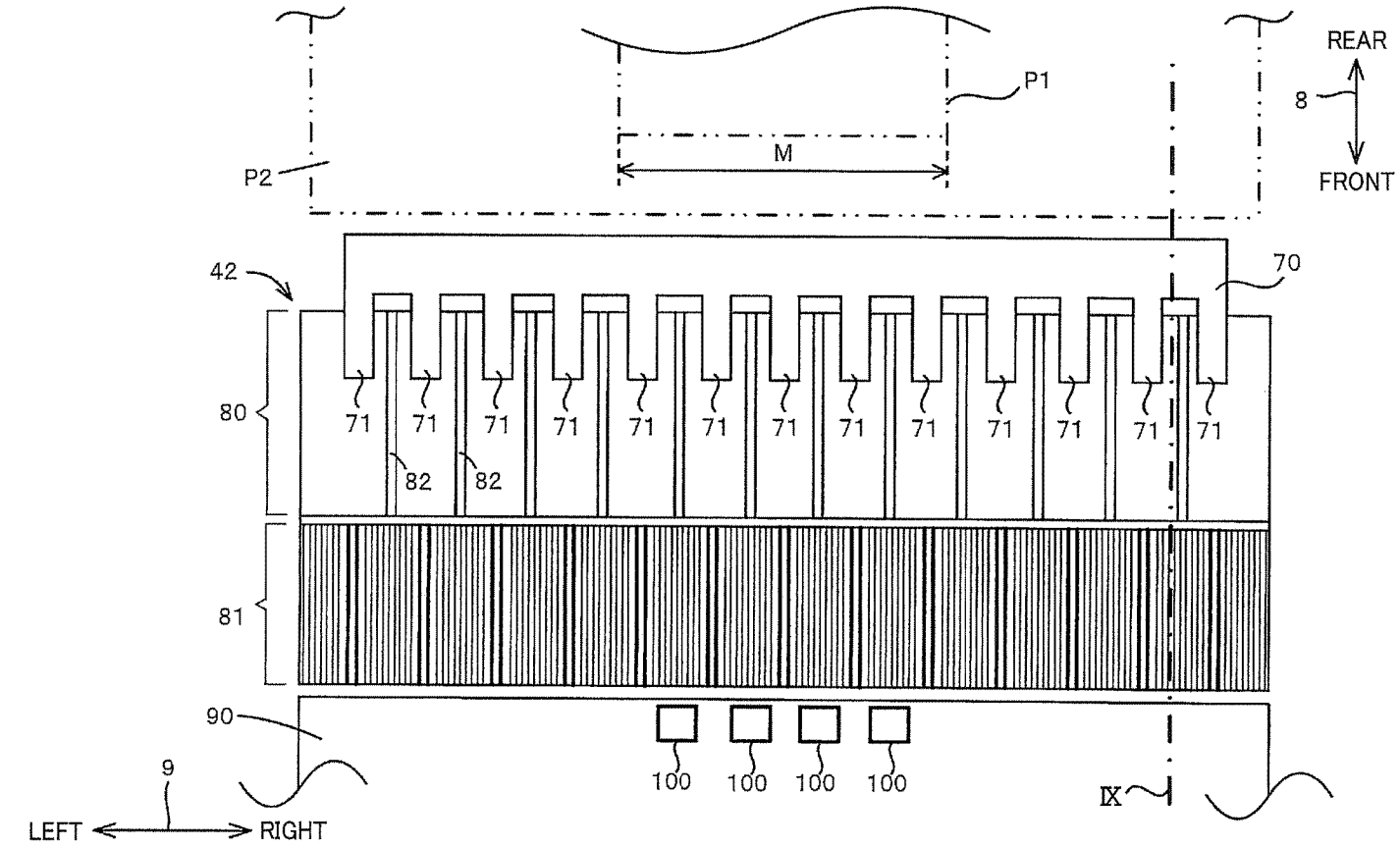
FIG. 5 is a plan view schematically illustrating a structure of the protrusions and components provided near the protrusions.

As illustrated in FIG. 5, the protrusions 100 are spaced apart from each other in the right and left direction 9. The protrusions 100 are disposed at a substantially central portion of the conveyance path 65 in the right and left direction 9. That is, in FIG. 5, a central portion of the four protrusions in the right and left direction 9 substantially coincides with a central portion of the conveyance path 65 in the right and left direction 9. A region in which the protrusions 100 are arranged in the right and left direction 9 is located within a region of the length M of the small-size sheet P1 in the right and left direction 9. That is, the protrusions 100 are arranged within a region through which the small-size sheet P1 is conveyed along the conveyance path 65. It is noted that while the protrusions 100 are arranged in the right and left direction 9 in the present embodiment, a single protrusion 100 may be disposed within the region through which the small-size sheet P1 is conveyed. Since the central portion of the small-size sheet P1 stored in the sheet-supply tray 20 coincides with the central portion of the sheet-supply tray 20 in the right and left direction 9 as described above, a central portion of the region through which the small-size sheet P1 is conveyed along the conveyance path 65 contains the central portion of the conveyance path 65 in the right and left direction 9. A central portion of the region through which the ordinary-size sheet P2 is conveyed also contains the central portion of the conveyance path 65 in the right and left direction 9. Accordingly, the region through which the small-size sheet P1 is conveyed is contained in the right and left direction 9 in the region through which the ordinary-size sheet P2 is conveyed, and the region through which the small-size sheet P1 is conveyed is located in the central portion of the region through which the ordinary-size sheet P2 is conveyed, in the right and left direction 9. More specifically, opposite ends of the region through which the small-size sheet P1 is conveyed are respectively spaced apart from opposite ends of the region through which the ordinary-size sheet P2 is conveyed, at the substantially same distance. In view of the above, the protrusions 100 are arranged in the right and left direction 9 within the region through which the small-size sheet P1 is conveyed, and are not arranged outside the region through which the small-size sheet P1 is conveyed and within the region through which the ordinary-size sheet P2 is conveyed.

Contact Member 70

As illustrated in FIG. 2, a contact member 70 is disposed between the conveying roller pair 58 and the recording head 38. The contact member 70 is mounted on the above-described guide rails for supporting the carriage 40 and urged downward by a resilient member, not illustrated, such as a spring. As illustrated in FIG. 5, the contact member 70 has a plurality of contact portions 71, each of which is located between corresponding two of the upstream ribs 82 of the platen 42 in the right and left direction 9. Since the contact member 70 is urged downward by the resilient member, the contact portions 71 are in contact with the upper surface of the base plate portion of the first supporter 80 of the platen 42. When the sheet P conveyed along the conveyance path 65 enters an area between the platen 42 and the contact portions 71 of the contact member 70, the contact portions 71 are moved upward against an urging force of the resilient member by an amount corresponding to the thickness of the sheet P and push the sheet P downward. It is noted that FIGS. 4 and 8-12 omit illustration of the contact member 70.

Figure 6:
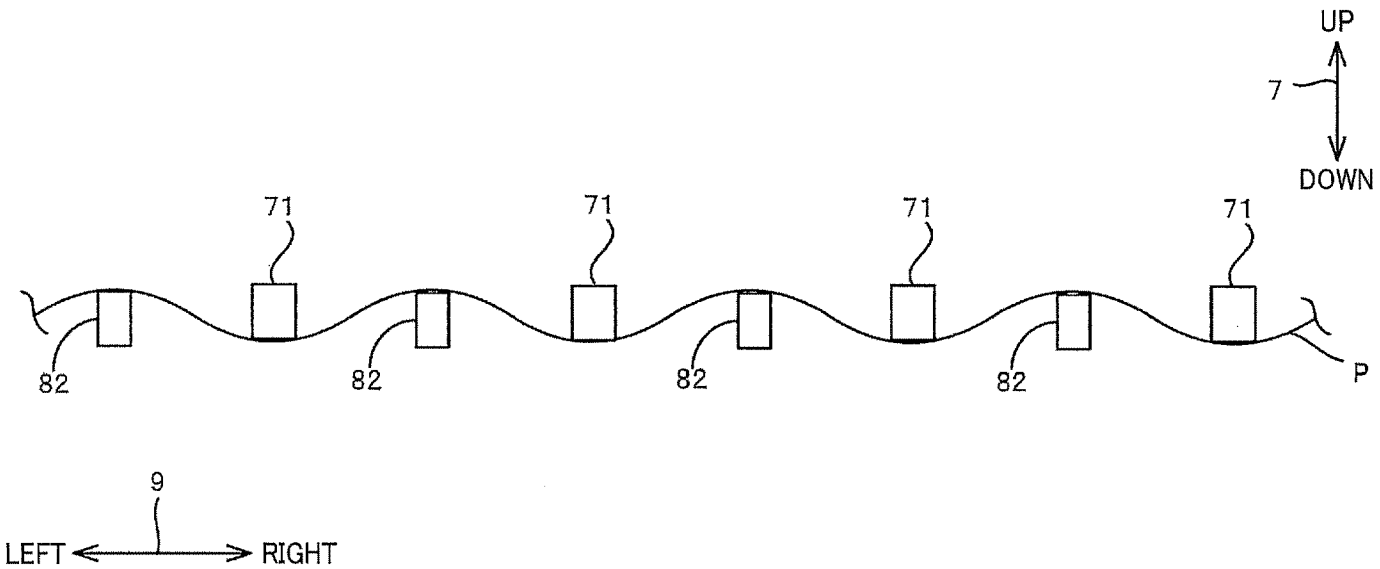
FIG. 6 is a schematic view illustrating a state in which a sheet is shaped into a wave along the right and left direction by contact portions of a contact member and upstream ribs of the platen.

The height of the upstream ribs 82 of the platen 42 is higher than the height level of the contact portions 71 moved upward by the amount corresponding to the thickness of the sheet P. Accordingly, since the sheet P supported by the upstream ribs 82 of the platen 42 is pressed from above by the contact portions 71 of the contact member 70, as illustrated in FIG. 6, the sheet P is shaped into a wave constituted by protrusions (convex shape) and recessions (concave shape) alternately arranged in the right and left direction 9. Since the upstream ribs 82 of the platen 42 are higher than the contact portions 71 of the contact member 70, each of portions of the sheet P having the waveform which are supported by the upstream ribs 82 of the platen 42 has a convex shape, and each of portions of the sheet P having the waveform which are pressed by the contact portions 71 of the contact member 70 has a concave shape.

Figure 7:
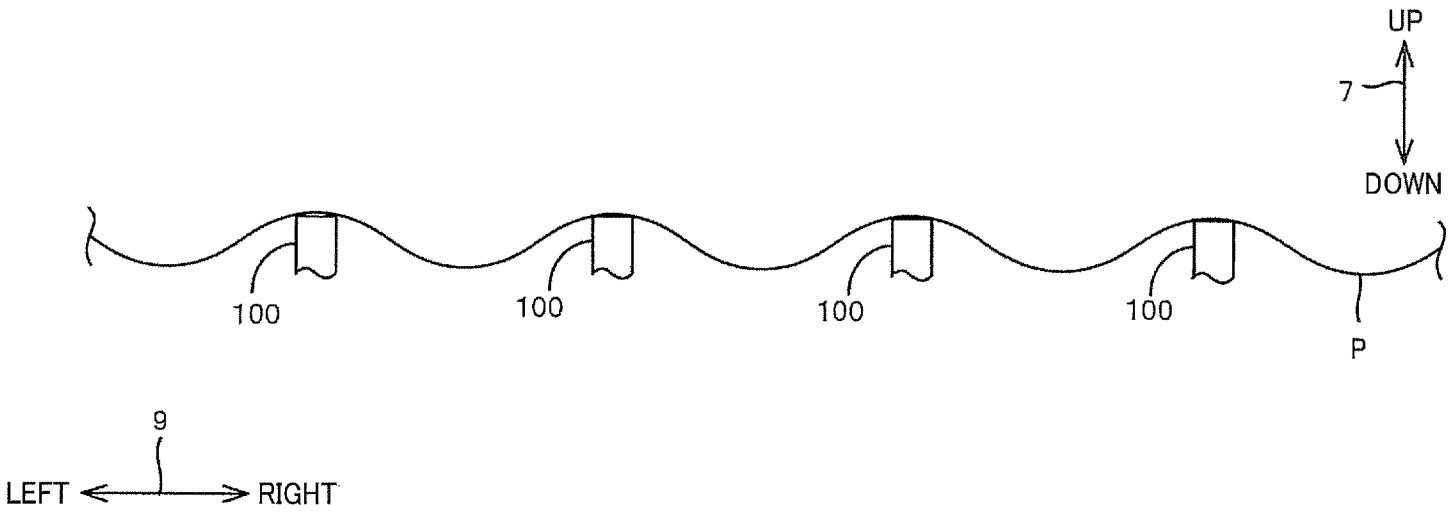
FIG. 7 is a schematic view illustrating a state in which convex portions of the sheet having the waveform are supported by the protrusions.

As illustrated in FIG. 5, the protrusions 100 are arranged at positions corresponding to the upstream ribs 82 of the platen 42 in the right and left direction 9. Thus, as illustrated in FIG. 7, the protrusions 100 are disposed at positions at which the protrusions 100 can respectively support the convex portions of the sheet P having the waveform from below. With this configuration, the protrusions 100 also shape the sheet P into a wave by cooperating with the contact portions 71. Also, the protrusions 100 prevent the waveform from being distorted due to downward deformation of the convex portions of the sheet P having the waveform which passes through the upstream ribs 82 of the platen 42.

Conveyance of Small-Size Sheet P1

Figure 8:
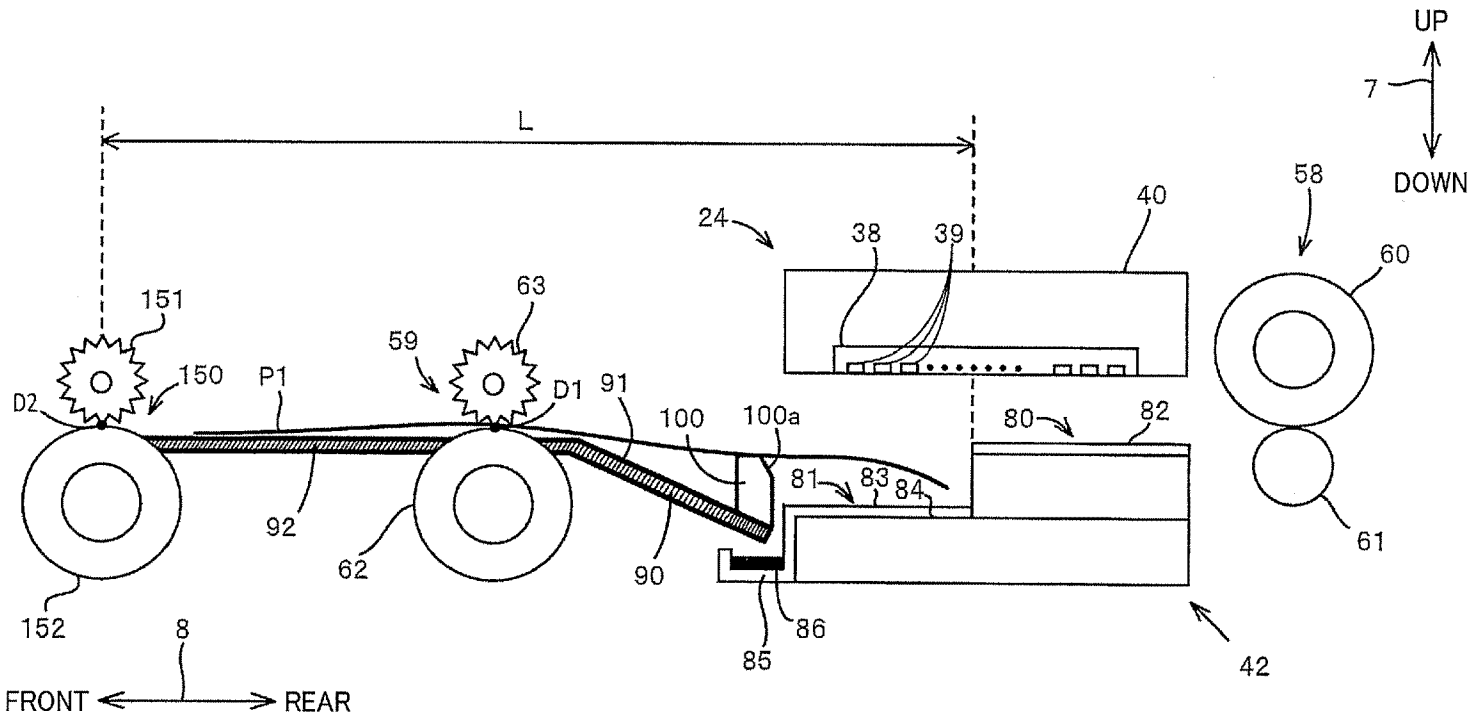
FIG. 8 is a side view schematically illustrating a structure of the protrusions and components provided near the protrusions when a small-size sheet is conveyed.

FIG. 8 illustrates a state in which the small-size sheet P1 is conveyed by the first output roller pair 59 after a trailing edge of the small-size sheet P1 passes through the first supporter 80 of the platen 42. When the small-size sheet P1 conveyed by the conveying roller pair 58 in the conveying direction 15 is conveyed to a recording starting position located in a region of the platen 42 which is opposed to the recording head 38, the carriage 40 starts to be reciprocated in the right and left direction 9 to start image recording on the small-size sheet P1. When the image recording is started, the small-size sheet P1 is conveyed by the conveying roller pair 58 in the conveying direction 15, and a desired image is formed by the recording head 38. When a leading edge of the small-size sheet P1 is conveyed through the platen 42 and a space over the protrusions 100, the small-size sheet P1 is conveyed in the conveying direction 15 along the inclined surface 91 of the first guide member 90 and nipped by the first output roller pair 59.

The small-size sheet P1 whose leading edge portion is nipped by the first output roller pair 59 is conveyed by the conveying roller pair 58 and the first output roller pair 59. When the trailing edge of the small-size sheet P1 passes through the nipping position of the conveying roller pair 58, the small-size sheet P1 is conveyed only by the first output roller pair 59. When the trailing edge of the small-size sheet P1 conveyed by the first output roller pair 59 has thereafter passed through the first supporter 80 of the platen 42 and reached a position opposed to the second supporter 81, the protrusions 100 support a lower surface of the small-size sheet P1. As described above, the upper ends of the respective downstream ribs 83 of the second supporter 81 and the upper surfaces of the respective ink landing portions 84 are located below the height level of the upper ends of the respective upstream ribs 82 of the first supporter 80. Thus, when the trailing edge of the small-size sheet P1 has passed through the first supporter 80, the trailing edge is hung down by its own weight. Here, a distance L (see FIG. 8) between the nipping position D2 of the sheet P by the second output roller pair 150 and the rear end portion of the second supporter 81 in the front and rear direction 8 is greater than the length of the small-size sheet P1 in the front and rear direction 8. Also as understood from FIG. 8, since the conveying direction 15 from the second supporter 81 to the second output roller pair 150 substantially coincides with the front and rear direction 8, the distance in the conveying direction 15 between the nipping position D2 of the sheet P by the second output roller pair 150 and the rear end portion of the second supporter 81 is also greater than the length of the small-size sheet P1 in the conveying direction 15. Thus, the small-size sheet P1 is nipped by only the first output roller pair 59 when the trailing edge of the small-size sheet P1 passes through the first supporter 80. In the case of a sheet (e.g., the ordinary-size sheet P2) whose trailing edge passes through the first supporter 80 in a state in which the sheet is nipped by the first output roller pair 59 and the second output roller pair 150 (that is, in the case of a sheet larger in size than the small-size sheet P1), a posture of a leading edge portion of the sheet is stabilized by the nip of the sheet at the two points, resulting in few changes of a posture of the entire sheet P. In the case of the small-size sheet P1 nipped at the single point, the posture of the leading edge is less stable than in the case of the sheet nipped at the two points, so that a posture of the entire small-size sheet P1 easily changes. Thus, the trailing edge of the small-size sheet P1 is easily hung down by not only its own weight but also instability of the posture due to the nip at the single point.

The hung-down trailing edge of the small-size sheet P1 may be brought into contact with the ink landing portions 84 and the downstream ribs 83. As described above, the downstream ribs 83 support the sheet P to prevent the sheet P from contacting the ink collected in the ink landing portions 84. However, the ink ejected from the nozzles 39 during the borderless printing is landed not only on the ink landing portions 84 but also on the downstream ribs 83. Thus, the sheet P may be soiled with the ink by contacting the downstream ribs 83. Also, some amount of the ink ejected from the nozzles 39 by the recording head 38 during the borderless printing is in some cases accumulated in the ink landing portions 84. Thus, in the case where the hung-down trailing edge of the sheet P comes into contact with the ink landing portions 84, the sheet P may be soiled with the ink more severely than in the case where the sheet P comes into contact with the downstream ribs 83.

As described above, the protrusions 100 are disposed between the second supporter 81 of the platen 42 and the second guide member 92 in the front and rear direction 8. Since the region in which the protrusions 100 are disposed in the right and left direction 9 overlaps the region through which the small-size sheet P1 is conveyed, the protrusions 100 support the hung-down trailing edge of the small-size sheet P1 from below. This support prevents the trailing edge of the small-size sheet P1 from contacting the ink landing portions 84 and the downstream ribs 83 of the second supporter 81 and prevents the trailing edge of the small-size sheet P1 from being soiled with the ink.

As described above, the height of the upper ends of the respective protrusions 100 is lower than the height of the upper ends of the respective upstream ribs 82 of the first supporter 80. Thus, the leading edge of the sheet P which has passed through the upstream ribs 82 of the first supporter 80 does not come into contact with the rear surfaces of the protrusions 100 in the front and rear direction 8. Also, since the protrusions 100 have the respective inclined surface 100*a*, even if the leading edge of the sheet P comes into contact with the rear surfaces of the protrusions 100 in the front and rear direction 8, the inclined surfaces 100*a* guide the leading edge of the sheet P toward the upper ends of the respective protrusions 100, thereby preventing the protrusions 100 from interfering with the conveyance.

Conveyance of Ordinary-Size Sheet P2

Figure 9:
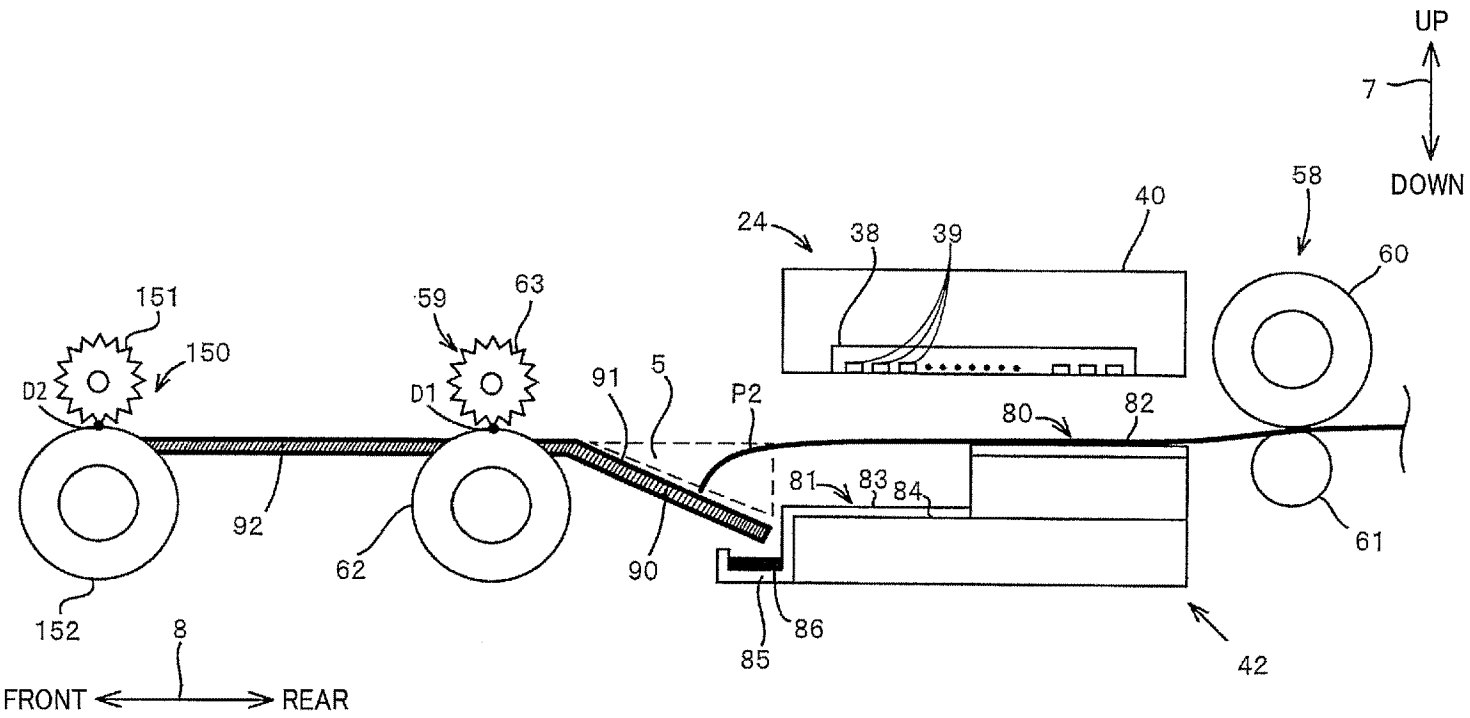
FIG. 9 is a side view schematically illustrating a structure of the protrusions and components provided near the protrusions when an ordinary-size sheet is conveyed.

FIG. 9 illustrates a state in which the ordinary-size sheet P2 is conveyed by the conveying roller pair 58 after a leading edge of the ordinary-size sheet P2 passes through the second supporter 81 of the platen 42. It is noted that FIG. 9 is for explaining a state of opposite edge portions of the ordinary-size sheet P2 (larger than the small-size sheet P1) in the right and left direction 9, and does not illustrate the protrusions 100 because FIG. 9 is a cross sectional view taken along one-dot chain line IX in FIG. 5. The length of the ordinary-size sheet P2 in the right and left direction 9 is greater than the length of the contact member 70 in the right and left direction 9 (see FIG. 5). The length of the ordinary-size sheet P2 in the front and rear direction 8 is greater than the distance L (see FIG. 8) in the front and rear direction 8 between the nipping position D2 of the sheet P by the second output roller pair 150 and a rear end portion of an upper surface of the second supporter 81. That is, the distance L (see FIG. 8) between the nipping position D2 of the sheet P by the second output roller pair 150 and the rear end portion of the second supporter 81 in the front and rear direction 8 is less than the length of the ordinary-size sheet P2 in the front and rear direction 8. As also understood from FIG. 8, since the conveying direction 15 from the second supporter 81 to the second output roller pair 150 substantially coincides with the front and rear direction 8, the distance in the conveying direction 15 between the nipping position D2 of the sheet P by the second output roller pair 150 and the rear end portion of the second supporter 81 is also less than the length of the ordinary-size sheet P2 in the conveying direction 15. When the ordinary-size sheet P2 conveyed by the conveying roller pair 58 in the conveying direction 15 has reached the recording starting position located in the region of the platen 42 which is opposed to the recording head 38, the carriage 40 starts to be reciprocated in the right and left direction 9 to start image recording on the ordinary-size sheet P2. When the image recording is started, the ordinary-size sheet P2 is conveyed by the conveying roller pair 58 in the conveying direction 15, and a desired image is formed by the recording head 38.

When the ink ejected from the nozzles 39 of the recording head 38 is absorbed in the ordinary-size sheet P2, grains of an upper surface of the ordinary-size sheet P2, which have absorbed water of the ink, get longer, whereby the ordinary-size sheet P2 is deformed so as to swell upward. Since the ordinary-size sheet P2 is conveyed by the short-grain conveyance, as described above, the direction of the grain along the long sides of the sheet P2 is parallel with the right and left direction 9. Thus, when swollen, the ordinary-size sheet P2 is deformed such that the ordinary-size sheet P2 swells more greatly at its trailing edge portion than at its leading edge portion in the conveying direction 15, in other words, the ordinary-size sheet P2 swells more greatly at its rear edge portion than at its front edge portion in the front and rear direction 8. Accordingly, the deformed ordinary-size sheet P2 may be soiled with the ink by contacting the nozzles 39 of the recording head 38. To prevent the deformation of the sheet P due to the swell, as described above, the sheet P is shaped into a wave by the contact portions 71 of the contact member 70 and the upstream ribs 82 of the platen 42 to increase the stiffness of the sheet P in order to prevent deformation of the posture of the sheet P.

Figure 10:
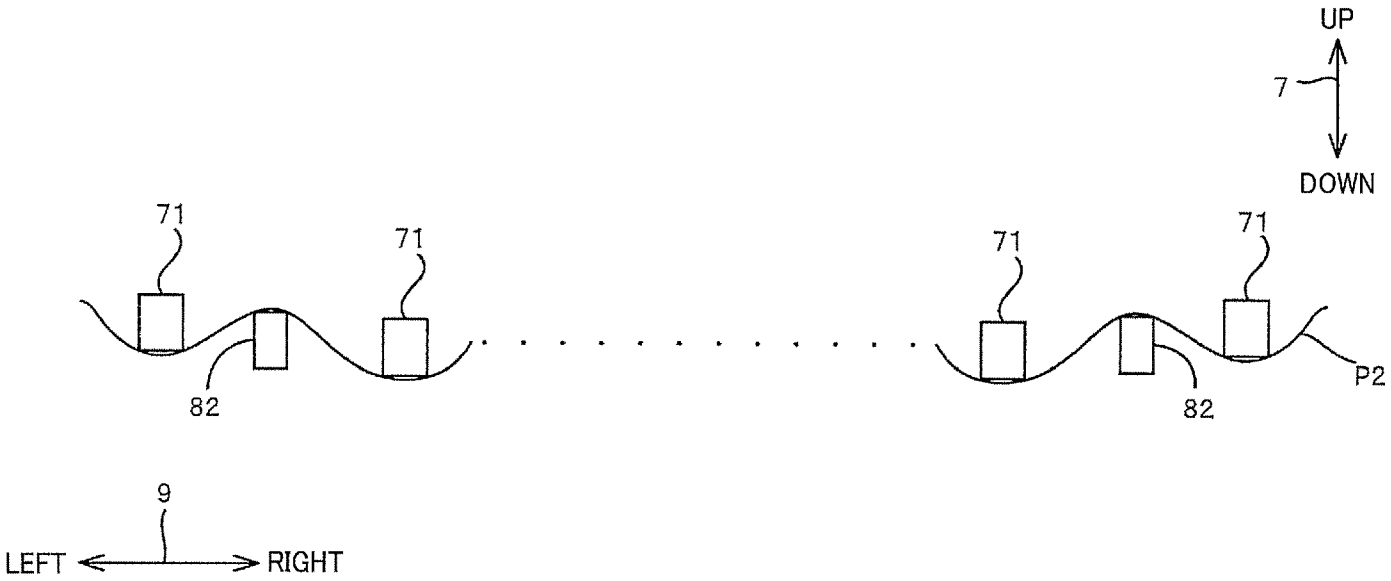
FIG. 10 is a schematic view for explaining positions of opposite outermost two of the contact portions of the contact member in the right and left direction.

Here, as illustrated in FIG. 10, opposite outermost two of the contact portions 71 of the contact member 70 in the right and left direction 9 are higher than the other contact portions 71. While a portion of the waveform is in some cases made larger by, e.g., great deformation of a portion of the sheet which has absorbed a large amount of the ink, this construction is for uniforming the size of the protrusions and recessions of the waveform by relieving the deformation toward outer sides in the right and left direction 9. To uniform, in the right and left direction 9, the entire waveform locally deformed greatly, the sheet P needs to be extended in the right and left direction 9 by an amount of the deformation, but in the case where the opposite outermost contact portions 71 in the right and left direction 9 are located at the same height as the other contact portions 71, the opposite outermost contact portions 71 interfere with the extension of the sheet P toward the outer sides in the right and left direction 9, so that the sheet P cannot be extended sufficiently toward the outer sides in the right and left direction 9. In the case where the opposite outermost contact portions 71 in the right and left direction 9 are located at the higher height level than the other contact portions 71 as in the present embodiment, the opposite outermost contact portions 71 are farther from the sheet P than the other contact portions 71, making it possible for the sheet P to be extended toward the outer sides in the right and left direction 9 to uniform the waveform. In this construction, however, a smaller downward force is applied from the contact portion 71 to opposite end portions of the ordinary-size sheet P2 in the right and left direction 9 than to a central portion of the ordinary-size sheet P2 in the right and left direction 9. Thus, when the ink is absorbed, the ordinary-size sheet P2 is more easily swollen upward at its opposite end portions than its central portion in the right and left direction 9.

As illustrated in FIG. 9, when the leading edge of the ordinary-size sheet P2 conveyed by the conveying roller pair 58 during ink ejection performed by the recording head 38 has passed through the second supporter 81 of the platen 42, a leading end portion of the ordinary-size sheet P2 is hung down by its own weight toward a space 5 located over the inclined surface 91 of the first guide member 90. As illustrated in FIG. 5, since the protrusions 100 are arranged in the right and left direction 9 in the region through which the small-size sheet P1 is conveyed, the opposite end portions of the ordinary-size sheet P2 in the right and left direction 9 are not supported by the protrusions 100 and are allowed to hang down toward the space 5. As described above, the opposite end portions of the ordinary-size sheet P2 in the right and left direction 9 are swollen upward more easily than the central portion of the ordinary-size sheet P2 in the right and left direction 9, resulting in a higher possibility that the opposite end portions are soiled with the ink by contacting the nozzles 39. In the present embodiment, however, the protrusions 100 are arranged within the region through which the small-size sheet P1 is conveyed, and the space 5 is formed at a position corresponding to the opposite end portions of the ordinary-size sheet P2 in the right and left direction 9. Thus, even in case where the opposite end portions of the ordinary-size sheet P2 in the right and left direction 9 (i.e., the portions of the ordinary-size sheet P2 which respectively correspond to the opposite outermost contact portions 71 in the right and left direction 9) are swollen by the ink, the opposite end portions hang down toward the space 5 so as to increase the distance between the recording head 38 and each of the opposite end portions, thereby preventing the opposite end portions from contacting the nozzles 39.

As described above, since the length of the ordinary-size sheet P2 in the conveying direction 15 is greater than the distance in the conveying direction 15 between the nipping position D2 of the sheet P by the second output roller pair 150 and the rear end portion of the upper surface of the second supporter 81, the ordinary-size sheet P2 is nipped by the first output roller pair 59 and the second output roller pair 150 when the trailing edge of the ordinary-size sheet P2 passes through the first supporter 80 and reaches the position opposed to the second supporter 81. When compared with the posture of the leading edge of the small-size sheet P1 nipped by only the first output roller pair 59, the posture of the leading edge of the ordinary-size sheet P2 nipped at the two points is stable and does not easily change, and accordingly the trailing edge portion of the ordinary-size sheet P2 does not hang down easily.

However, since the trailing edge of the ordinary-size sheet P2 hangs down due to its own weight, as in the case of the small-size sheet P1, there is a possibility that the trailing edge of the ordinary-size sheet P2 is brought into contact with the ink landing portions 84 and the downstream ribs 83 and thereby soiled with the ink ejected onto the outside of the ordinary-size sheet P2 in the borderless printing. However, the protrusions 100 support the central portion of the ordinary-size sheet P2 in the right and left direction 9 from below, thereby reducing the hanging-down of the trailing edge of the ordinary-size sheet P2.

Effects

In the present embodiment, the protrusions 100 are capable of supporting the trailing edge of the sheet P between the platen 42 and the first output roller pair 59. In the right and left direction 9, the protrusions 100 are arranged within the region through which the small-size sheet P1 is conveyed. This construction prevents the hung-down trailing edge of the small-size sheet P1 from contacting the ink landing portions 84 and the downstream ribs 83 of the platen 42 and prevents the trailing edge of the small-size sheet P1 from being soiled with the ink ejected on the ink landing portions 84 and the downstream ribs 83.

In the present embodiment, the protrusions 100 are arranged only in the region through which the small-size sheet P1 is conveyed. Thus, the protrusions 100 do not support the opposite ends of the ordinary-size sheet P2 (larger than the small-size sheet P1 in size) in the right and left direction 9. With this construction, the opposite ends, in the right and left direction 9, of the ordinary-size sheet P2 swollen upward by the absorbed ink can hang down toward the inclined surface 91 of the first guide member 90, thereby preventing the ordinary-size sheet P2 from being soiled by contacting the nozzles 39 of the recording head 38.

In the present embodiment, the first guide member 90 has the inclined surface 91 inclined so as to be higher at its front portion than at its rear portion. This configuration enables the sheet P to be easily conveyed to the nipping position D1 of the first output roller pair 59 along the inclined surface 91.

In the present embodiment, the contact portions 71 of the contact member 70 and the upstream ribs 82 of the platen 42 shape the sheet P into a wave along the right and left direction 9. This operation stabilizes the posture of the sheet P to reduce deformation of the sheet P due to, e.g., swell of the sheet P which is caused by absorption of the ink.

In the present embodiment, the protrusions 100 are arranged at the positions corresponding to the upstream ribs 82 of the platen 42 in the right and left direction 9, that is, the protrusions 100 are arranged at the positions for supporting the convex portions of the sheet P having the waveform. With this construction, the protrusions 100 also cooperate with the contact portions 71 to shape the sheet P into a wave. The protrusions 100 also prevents the convex portions from moving downward so as to distort the waveform of the sheet P after the sheet P passes through the contact member 70. Since the plurality of protrusions 100 are arranged in the right and left direction 9, the protrusions 100 can stably support the small-size sheet P1.

First Modification

In the above-described embodiment, the upper surface of the first guide member 90 is the inclined surface 91. However, the upper surface of the first guide member 90 may not be the inclined surface 91 as long as the upper surface of the first guide member 90 guides the sheet P to the nipping position D1. For example, the upper surface of the first guide member 90 may be a curved surface curved frontward and upward. The curved surface in this modification is another example of the guide surface.

Second Modification

Figure 11:
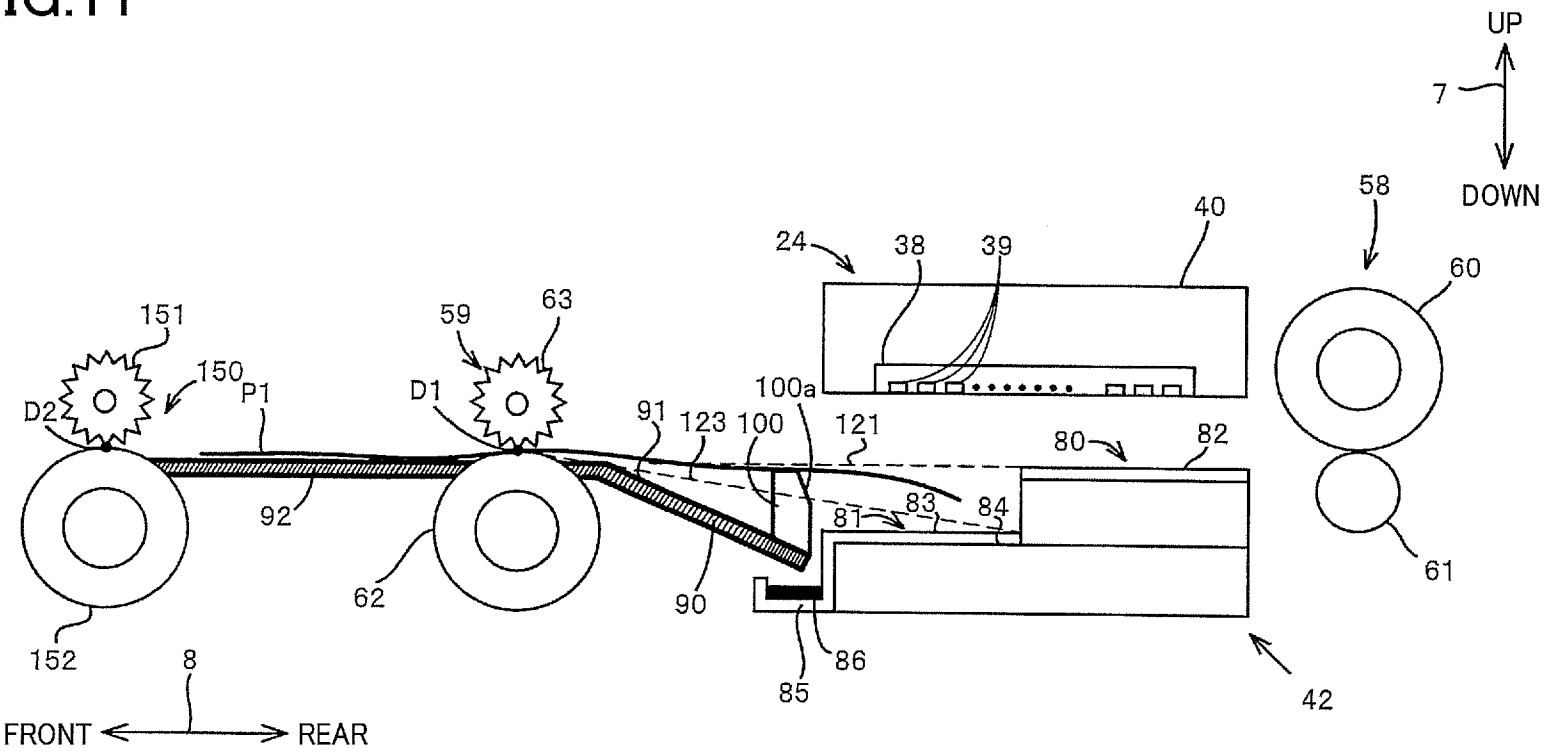
FIG. 11 is a side view schematically illustrating a structure of protrusions and components provided near the protrusions in a second modification.

In the above-described embodiment, the height level of the upper ends of the respective protrusions 100 in the up and down direction 7 is located above the imaginary line 122 connecting between the nipping position D1 of the first output roller pair 59 and the front end portions of the upper ends of the respective downstream ribs 83 of the second supporter 81 and is located below the imaginary line 121 horizontally extending in the front and rear direction 8 from the upper ends of the respective upstream ribs 82 of the first supporter 80. As illustrated in FIG. 11, however, the height level of the upper ends of the respective protrusions 100 in the up and down direction 7 may be located above an imaginary line 123 (as one example of a second imaginary line) connecting between the nipping position D1 and rear end portions of the upper ends of the respective downstream ribs 83 of the second supporter 81 and is located below the imaginary line 121 horizontally extending in the front and rear direction 8 from the upper ends of the respective upstream ribs 82 of the first supporter 80.

In the second modification, when the trailing edge of the sheet P has passed through the first supporter 80 and reached the position opposed to the second supporter 81, the trailing edge of the sheet P is supported by the protrusions 100 at a higher position. This configuration prevents the trailing edge of the sheet P from being soiled with the ink ejected on the downstream ribs 83 and the ink landing portions 84 of the second supporter 81.

Third Modification

Figure 12:
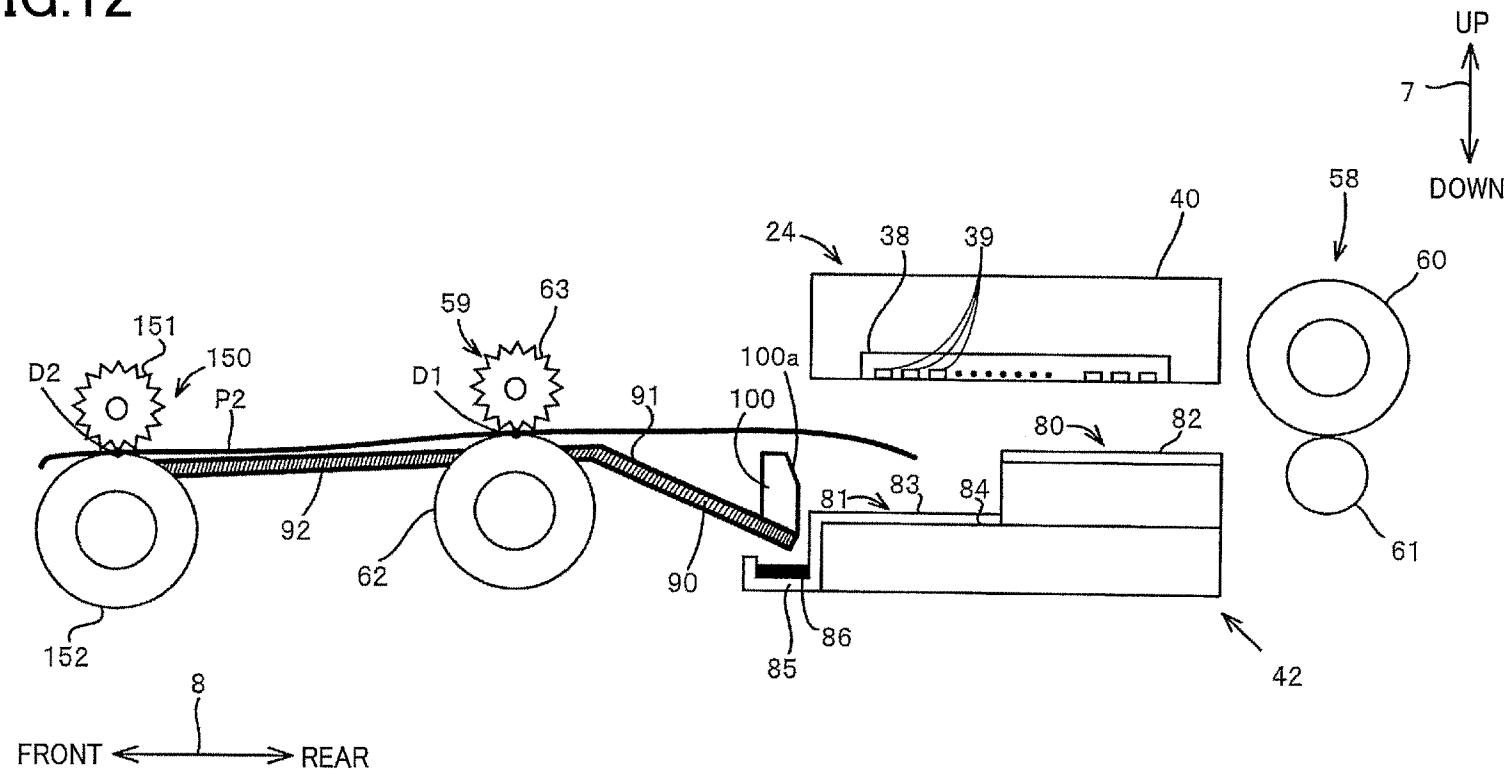
FIG. 12 is a side view schematically illustrating a structure of protrusions and components provided near the protrusions in a third modification.

As illustrated in FIG. 12, the height level of the nipping position D2 of the second output roller pair 150 in the up and down direction 7 may be lower than that of the nipping position D1 of the first output roller pair 59 in the up and down direction 7. In this modification, in the state in which the ordinary-size sheet P2 is nipped by the first output roller pair 59 and the second output roller pair 150 when the trailing edge of the ordinary-size sheet P2 has reached the second supporter 81 of the platen 42, the ordinary-size sheet P2 is inclined so as to be higher at the trailing portion than at the leading portion except the trailing edge portion. Since the trailing portion of the ordinary-size sheet P2 is raised, it is possible to reduce the possibility that the trailing edge of the ordinary-size sheet P2 is soiled by contacting the ink landing portions 84 and the downstream ribs 83 of the platen 42.

Fourth Modification

The protrusions 100 are disposed on the rear end portion of the first guide member 90 between the second supporter 81 of the platen 42 and the second guide member 92 in the front and rear direction 8 in the above-described embodiment, but the present disclosure is not limited to this configuration. As illustrated in FIG. 8, the protrusions 100 at least have to reduce the hanging-down of the trailing edge of the sheet P when the sheet P is nipped by the first output roller pair 59. Thus, the protrusions 100 at least have to be disposed between the first output roller pair 59 and the portions of the ink landing portions 84 which function as the ink receiver, in the front and rear direction 8. Accordingly, the protrusions 100 may be provided on a component located at a rear of the first guide member 90. For example, the protrusions 100 may be provided on a portion of the second supporter 81, which portion is located in front of the portions of the ink landing portions 84 which function as the ink receiver.

What is claimed is:

1. An ink-jet recording apparatus, comprising:

an image recorder defining therein a plurality of nozzles and configured to eject ink from the plurality of nozzles onto a sheet to perform image recording, the image recorder being capable of performing the image recording on any of a first-size sheet and a second-size sheet, the first-size sheet having a first size, the second-size sheet having a second size different from the first size, wherein a length of the second-size sheet in a conveying direction in which the sheet is conveyed is less than a length of the first-size sheet in the conveying direction, and a length of the second-size sheet in a widthwise direction orthogonal to the conveying direction is less than a length of the first-size sheet in the widthwise direction;

a first supporter comprising a plurality of support ribs spaced apart from each other in the widthwise direction, the plurality of support ribs each extending from a position located upstream of the image recorder in the conveying direction toward a position located downstream of the image recorder in the conveying direction to a position under the image recorder to support the sheet;

an ink receiver disposed downstream of the plurality of support ribs in the conveying direction and below the plurality of support ribs, the ink receiver being opposed to the plurality of nozzles such that the ink receiver is configured to receive the ink ejected from the plurality of nozzles of the image recorder when borderless printing is performed on one of a downstream edge and an upstream edge of the sheet in the conveying direction;

a first roller pair disposed downstream of the first supporter in the conveying direction and configured to convey the sheet in the conveying direction;

a second roller pair disposed downstream of the first roller pair in the conveying direction;

a guide comprising a guide surface extending from a position located downstream of the ink receiver in the conveying direction and below the ink receiver, toward a downstream side in the conveying direction and toward a nip position of the first roller pair at which the sheet is nipped by the first roller pair, the guide surface being configured to guide the sheet toward the nip position of the first roller pair; and a protrusion disposed between the ink receiver and the first roller pair, an upper end of the protrusion being located below upper ends of the plurality of support ribs and above a first imaginary line connecting between the nip position of the first roller pair and a downstream end of the ink receiver in the conveying direction, a height level of the upper end of the protrusion being higher than a height level of an upper end of the ink receiver, wherein a distance between an upstream end of the ink receiver in the conveying direction and a nip position of the second roller pair at which the sheet is nipped by the second roller pair is less than the length of the first-size sheet in the conveying direction and greater than the length of the second-size sheet in the conveying direction, and wherein the protrusion is disposed, in the widthwise direction, in a region through which the second-size sheet is conveyed.

2. The ink-jet recording apparatus according to claim 1, further comprising a second supporter comprising the ink receiver and disposed downstream of the first supporter in the conveying direction, wherein the protrusion is disposed between the second supporter and the first roller pair in the conveying direction.

3. The ink-jet recording apparatus according to claim 1, wherein the protrusion is not disposed in an outside region that is located, in the widthwise direction, outside the region through which the second-size sheet is conveyed and within a region through which the first-size sheet is conveyed.

4. The ink-jet recording apparatus according to claim 1, wherein the first-size sheet and the second-size sheet are conveyed such that opposite ends, in the widthwise direction, of the region through which the second-size sheet is conveyed are respectively spaced, at an identical distance, apart from opposite ends, in the widthwise direction, of the region through which the first-size sheet is conveyed, and wherein the protrusion is disposed, in the widthwise direction, in the region through which the second-size sheet is conveyed and is not disposed in an outside region that is located, in the widthwise direction, outside the region through which the second-size sheet is conveyed and within the region through which the first-size sheet is conveyed.

5. The ink-jet recording apparatus according to claim 1, wherein the upper end of the protrusion is located above a second imaginary line connecting between the nip position of the first roller pair and the upstream end of the ink receiver in the conveying direction and below the upper ends of the plurality of support ribs.

6. The ink-jet recording apparatus according to claim 1, wherein the guide surface of the guide is an inclined surface inclined so as to be higher at a downstream portion of the inclined surface in the conveying direction than at an upstream portion of the inclined surface in the conveying direction.

7. The ink-jet recording apparatus according to claim 1, further comprising a plurality of contact members disposed upstream of the plurality of nozzles in the conveying direction and each disposed between corresponding two of the plurality of support ribs in the widthwise direction, the plurality of contact members being contactable with an upper surface of the sheet at a height level below that of the upper ends of the plurality of support ribs to cooperate with the plurality of support ribs to shape the sheet into a wave.

8. The ink-jet recording apparatus according to claim 1, further comprising a plurality of protrusions, each as the protrusion, spaced apart from each other in the widthwise direction.

9. The ink-jet recording apparatus according to claim 8, wherein the plurality of protrusions are arranged so as to respectively correspond to the plurality of support ribs in the widthwise direction.

10. An ink-jet recording apparatus, comprising:

an image recorder defining therein a plurality of nozzles and configured to eject ink from the plurality of nozzles onto a sheet to perform image recording, the image recorder being capable of performing the image recording on any of a first-size sheet and a second-size sheet, the first-size sheet having a first size, the second-size sheet having a second size different from the first size, wherein a length of the second-size sheet in a conveying direction in which the sheet is conveyed is less than a length of the first-size sheet in the conveying direction, and a length of the second-size sheet in a widthwise direction orthogonal to the conveying direction is less than a length of the first-size sheet in the widthwise direction;

a first supporter comprising a plurality of support ribs spaced apart from each other in the widthwise direction, the plurality of support ribs each extending from a position located upstream of the image recorder in the conveying direction toward a position located downstream of the image recorder in the conveying direction to a position under the image recorder to support the sheet;

an ink receiver disposed downstream of the plurality of support ribs in the conveying direction and below the plurality of support ribs, the ink receiver being configured to receive the ink ejected from the plurality of nozzles of the image recorder when borderless printing is performed on one of a downstream edge and an upstream edge of the sheet in the conveying direction;

a first roller pair disposed downstream of the first supporter in the conveying direction and configured to convey the sheet in the conveying direction;

a second roller pair disposed downstream of the first roller pair in the conveying direction;

a guide comprising a guide surface extending from a position located downstream of the ink receiver in the conveying direction and below the ink receiver, toward a downstream side in the conveying direction and toward a nip position of the first roller pair at which the sheet is nipped by the first roller pair, the guide surface being configured to guide the sheet toward the nip position of the first roller pair; and a protrusion disposed between the ink receiver and the first roller pair, an upper end of the protrusion being located below upper ends of the plurality of support ribs and above a first imaginary line connecting between the nip position of the first roller pair and a downstream end of the ink receiver in the conveying direction, wherein a distance between an upstream end of the ink receiver in the conveying direction and a nip position of the second roller pair at which the sheet is nipped by the second roller pair is less than the length of the first-size sheet in the conveying direction and greater than the length of the second-size sheet in the conveying direction, wherein the protrusion is disposed, in the widthwise direction, in a region through which the second-size sheet is conveyed, and, wherein a height level of the nip position of the second roller pair is located below that of the nip position of the first roller pair.

* * * * *